US006893320B2

(12) United States Patent
Caiozza

(10) Patent No.: US 6,893,320 B2
(45) Date of Patent: May 17, 2005

(54) REMOTE CONTROL APPARATUS WITH USER-OPERATED CLUTCH CONTROLS

(76) Inventor: Joseph C. Caiozza, 321 W. Market St., Long Beach, NY (US) 11561

( * ) Notice: Subject to any disclaimer, the term of this patent is extended or adjusted under 35 U.S.C. 154(b) by 478 days.

(21) Appl. No.: 10/201,792

(22) Filed: Jul. 24, 2002

(65) Prior Publication Data

US 2004/0018800 A1 Jan. 29, 2004

(51) Int. Cl.[7] ..... A63H 30/00
(52) U.S. Cl. ..... 446/456; 446/454; 446/463
(58) Field of Search ..... 446/465, 463, 446/454, 457

(56) References Cited

U.S. PATENT DOCUMENTS 4,553,947 A * 11/1985 Weiland et al. ..... 446/443
4,823,632 A * 4/1989 Harrod et al. ..... 74/342
5,100,368 A * 3/1992 Chien ..... 475/149
5,178,251 A * 1/1993 Losi, Jr. ..... 192/48.3
6,413,143 B1 * 7/2002 Lu ..... 446/454

* cited by examiner

*Primary Examiner*—Jessica Harrison
*Assistant Examiner*—Corbett Coburn

(57) ABSTRACT

An ergonomically comfortable remote control apparatus includes a transmission controller unit and a transmitter unit electrically connected together. The transmission controller unit includes a transmission-controller-unit handle. An accelerator control finger lever and a brake control finger lever project outward from a first side of the transmission-controller-unit handle. A clutch thumb lever projects outward from a second side of the transmission-controller-unit handle. A steering wheel is connected to a portion of the transmission-controller-unit handle at a location above the accelerator control finger lever, the brake control finger lever, and the clutch thumb lever. A finger-operated steering control handle is connected to the steering wheel. A hand operated gear shift slide actuator is supported on the steering wheel and operates an upshift actuator button and a downshift actuator button located on the steering wheel.

25 Claims, 8 Drawing Sheets

REMOTE CONTROL APPARATUS WITH USER-OPERATED CLUTCH CONTROLS

BACKGROUND OF THE INVENTION

1. Field of the Invention

The present invention relates generally to remote control devices, and, more particularly, to radio-controlled remote control devices which are controlled by a hand-held controller.

2. Description of the Prior Art

Radio-controlled remote control devices which are controlled by a hand-held controller are well known in the art. In this respect, throughout the years, a number of innovations have been developed relating to such radio-controlled remote control devices, and the following U.S. Pat. Nos. are representative of some of those innovations: 4,865,575, 5,024,626, 5,195,920, 5,334,075, and 5,785,576.

More specifically, U.S. Pat. No. 4,865,575 discloses a light-responsive remote control vehicle that runs along a track that includes vertical side walls. In this respect, the vehicle does not include means for steering the vehicle. Also, in this respect, the hand-held controller does not include means for controlling steering. For greater realism in the vehicle, it would be desirable if the remote controlled vehicle had wheels that could be steered. Also, in this respect, it would be desirable if a hand-held controller had means for controlling steering of the controlled vehicle.

U.S. Pat. No. 5,024,626 discloses remote controlled vehicle that produces sounds. The wheels cannot be steered, as described above with respect to U.S. Pat. No. 4,865,575. Moreover, the remote controlled vehicle does not have separate gears that are shifted separately using a hand-held controller. To further approximate realism, it would be desirable if a remote controlled vehicle and a hand-held controller were provided with gears that are shifted or simulated gears that are shifted.

U.S. Pat. No. 5,195,920 discloses a radio-controlled model vehicle that has coordinated sound effects. The hand-held controller is able to control turning of the wheels as well. However, just as with U.S. Pat. No. 5,024,626 discussed above, the remote controlled vehicle does not have separate gears that are shifted separately using a hand-held controller. Moreover, this device does not include an independent control for braking the remote controlled vehicle. In this respect, to further approximate realism, it would be desirable if a hand-held controller were provided which includes an independent control for braking a remote controlled vehicle.

U.S. Pat. No. 5,334,075 discloses a radio-controlled car which is steered by changing the direction of rotation of the wheels, as opposed to being steered by moving the front two wheels as is done in a full size vehicle. Gears are provided for changing the direction of motion of the vehicle as opposed to changing the forward speed of the vehicle, as with a conventional automobile. Moreover, no control is provided on the hand-held controller for operating a clutch for changing gears. In a further effort to emulate realism, it would be desirable if a hand-held controller were provided for a remote controlled vehicle which includes a clutch control. Further along these lines, it would be desirable if a hand-held controller for a remote controlled vehicle were provided which includes a gear shift control that operates in conjunction with the clutch control for changing gears of the remote controlled vehicle.

U.S. Pat. No. 5,785,576 discloses a remote controlled vehicle which includes a selectable vehicle suspension system. As with other patents discussed above, this patent does not disclose a hand-held controller which includes a clutch control.

In general, prior art remote controlled vehicles are not controlled by separate clutch controls because such remote controlled vehicles include automatically engaging centrifugal clutches. A number of problems are associated with automatically engaging centrifugal clutches. One problem is that automatically engaging centrifugal clutches tend to wear out rapidly. Another problem associated with automatically engaging centrifugal clutches is that they do not provide preciseness and flexibility of control. In this respect, it would be desirable if a remote controlled vehicle and a hand-held controller were provided which includes an operator controlled clutch which provides greater preciseness and flexibility of control. As a result, a remote controlled vehicle and a hand-held controller would be provided that requires less down time due to repairs needed because of the rapidly wearing out of centrifugal clutches.

Still other features would be desirable in a remote control apparatus. It would be desirable if a hand-held controller were provided that is ergonomically comfortable for a user. More specifically, it would be desirable if a hand-held controller, that requires a person to use both hands for controlling a remote controlled vehicle, were ergonomically comfortable to both hands of the user.

With a remote controlled vehicle that has multiple gears, it would be desirable if a hand-held controller were provided which allows gears to be shifted incrementally, one gear selection at a time. More specifically, it would be desirable if the hand-held controller provides from both incremental upshifting and incremental downshifting.

Thus, while the foregoing body of prior art indicates it to be well known to use hand-held controllers for controlling remote controlled vehicles, the prior art described above does not teach or suggest a remote control apparatus which has the following combination of desirable features: (1) has means for controlling steering of the controlled vehicle; (2) has gears that are shifted or has simulated gears that are shifted; (3) includes an independent control for braking a remote controlled vehicle; (4) includes a hand operated clutch control; (5) includes a hand operated gear shift control that operates in conjunction with the clutch control for changing gears of the remote controlled vehicle; (6) includes an operator controlled clutch which provides greater preciseness and flexibility of control than a centrifugal clutch; (7) requires less down time for repairs compared to repairs needed for a centrifugal clutch that wears out rapidly; (8) has a hand-held controller which is ergonomically comfortable for a user; (9) has a hand-held controller, that requires a person to use both hands for controlling a remote controlled vehicle, wherein both hands are ergonomically comfortable to the user; (10) has a hand-held controller which allows gears to be shifted incrementally, one gear selection at a time; and (11) has a hand-held controller that provides for both incremental gear upshifting and incremental gear downshifting. The foregoing desired characteristics are provided by the unique remote control apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a remote control apparatus which includes a transmission controller unit and a transmitter unit electrically connected to the transmission controller unit. The transmission controller unit includes a transmission-controller-unit housing. A transmission-controller-unit handle is formed from a portion of the transmission-controller-unit housing. An accelerator control finger lever projects outward from a first side portion of the transmission-controller-unit housing. A brake control finger lever projects outward from the first side portion of the transmission-controller-unit housing. A clutch thumb lever projects outward from a second side portion of the transmission-controller-unit housing. A steering wheel is connected to a portion of the transmission-controller-unit housing at a location above the accelerator control finger lever, the brake control finger lever, and the clutch thumb lever. A steering control handle is connected to the steering wheel. A gear shift slide actuator is supported on the steering wheel. An upshift actuator button and a downshift actuator button are located on the steering wheel. The upshift actuator button and the downshift actuator button are operated by the gear shift slide actuator. The transmission controller unit controls the emission of radio waves from the transmitter unit for controlling a controlled vehicle.

The accelerator control finger lever projects outward from a first side portion of the transmission-controller-unit handle. The brake control finger lever projects outward from the first side portion of the transmission-controller-unit handle. The clutch thumb lever projects outward from a second side of the transmission-controller-unit handle. The steering wheel is connected to a top portion of the transmission-controller-unit handle. The transmission-controller-unit handle includes finger reception grooves.

A hand security strap can be connected to the transmission-controller-unit handle. A stopwatch control button is connected to the steering wheel. The stopwatch control button includes a first stopwatch button portion that extends outward from a first location on the steering wheel and includes a second stopwatch button portion that extends outward from a second location on the steering wheel.

Trim switches are supported by the transmission-controller-unit housing. Status light indicators are supported by the transmission-controller-unit housing. The trim switches and the status light indicators are located between the transmission-controller-unit handle and the steering wheel.

A controller-to-transmitter cable is connected between the transmission controller unit and the transmitter unit. The controller-to-transmitter cable includes a screw-on connector for connecting the controller-to-transmitter cable to the transmission controller unit and includes a screw-on connector for connecting the controller-to-transmitter cable to the transmitter unit.

The transmitter unit includes transmitter-unit housing. Batteries are housed inside the transmitter-unit housing. A transmitter antenna extends through the transmitter-unit housing. Radio transmitter controls are provided for controlling a transmitter housed inside the transmitter-unit housing.

A shoulder strap can be connected to the transmitter-unit housing. Screws and brackets are provided for securing the shoulder strap to the transmitter-unit housing.

The steering wheel includes a plurality of sets of steering-control-handle adjustment wells for receiving steering-control-handle adjustment screws for attaching the steering control handle to the steering wheel at selected positions on the steering wheel. A finger separator plate separates the accelerator control finger lever from the brake control finger lever.

The clutch thumb lever can be fitted alternatively to a left side of the transmission-controller-unit handle or to a right side of the transmission-controller-unit handle to accommodate a left-handed or a right-handed person.

The gear shift slide actuator includes a finger-powered upshift button pusher portion for pushing against the upshift actuator button. A finger-powered downshift button pusher portion is provided for pushing against the downshift actuator button, and rails extend between the finger-powered upshift button pusher portion and the finger-powered downshift button pusher portion. The rails ride on tracks supported by the steering wheel.

A rail support plate is supported on the steering wheel. The rail support plate includes notches providing the tracks. A top plate is provided for sandwiching the rails between the top plate and the rail support plate. Screws are provided for fastening the rail support plate and the top plate to the steering wheel.

With another embodiment of the invention, a controller-unit-to-transmitter-unit adapter is provided for connecting the transmission controller unit to the transmitter unit. The controller-unit-to-transmitter-unit adapter includes a screw-on connector for connecting to the transmission controller unit and includes a screw-on connector for connecting to the transmitter unit.

With another embodiment of the invention, a swivel assembly is connected between the transmission controller unit and the transmitter unit.

With other embodiments of the invention, the transmission controller unit and the transmitter unit are combined in a pistol-shaped housing.

With another embodiment of the invention, the accelerator control finger lever, a finger separator plate, and the brake control finger lever project outwardly from a first side of a pistol handle portion. The clutch thumb lever projects outward from a second side of the pistol handle portion. The steering wheel projects outward from a side of a pistol body portion. The transmitter antenna projects upward from a top portion of the pistol body portion.

With another embodiment of the invention, the accelerator control finger lever projects downward from the pistol body portion, and the steering control handle projects downward from the steering wheel which is supported by the pistol body portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least five preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote control apparatus which has all of the advantages of the prior art and none of the disadvantages.

It is another object of the present invention to provide a new and improved remote control apparatus which may be easily and efficiently manufactured and marketed.

It is a further object of the present invention to provide a new and improved remote control apparatus which is of durable and reliable construction.

An even further object of the present invention is to provide a new and improved remote control apparatus which is susceptible of a low cost of manufacture with regard to both materials and labor, and which accordingly is then susceptible of low prices of sale to the consuming public, thereby making such remote control apparatus available to the buying public.

Still yet a further object of the present invention is to provide a new and improved remote control apparatus which has means for controlling steering of the controlled vehicle.

Still another object of the present invention is to provide a new and improved remote control apparatus that has gears that are shifted or has simulated gears that are shifted.

Yet another object of the present invention is to provide a new and improved remote control apparatus which includes an independent control for braking a remote controlled vehicle.

Even another object of the present invention is to provide a new and improved remote control apparatus that includes a hand operated clutch control.

Still a further object of the present invention is to provide a new and improved remote control apparatus which includes a hand operated gear shift control that operates in conjunction with the clutch control for changing gears of the remote controlled vehicle.

Yet another object of the present invention is to provide a new and improved remote control apparatus that includes an operator controlled clutch which provides greater preciseness and flexibility of control than a centrifugal clutch.

Still another object of the present invention is to provide a new and improved remote control apparatus which requires less down time for repairs compared to repairs needed for a centrifugal clutch that wears out rapidly.

Yet another object of the present invention is to provide a new and improved remote control apparatus that has a hand-held controller which is ergonomically comfortable for a user.

Still a further object of the present invention is to provide a new and improved remote control apparatus that has a hand-held controller, that requires a person to use both hands for controlling a remote controlled vehicle, wherein both hands are ergonomically comfortable to the user.

Yet another object of the present invention is to provide a new and improved remote control apparatus which has a hand-held controller which allows gears to be shifted incrementally, one gear selection at a time.

Still a further object of the present invention is to provide a new and improved remote control apparatus that has a hand-held controller that provides for both incremental gear upshifting and incremental gear downshifting.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
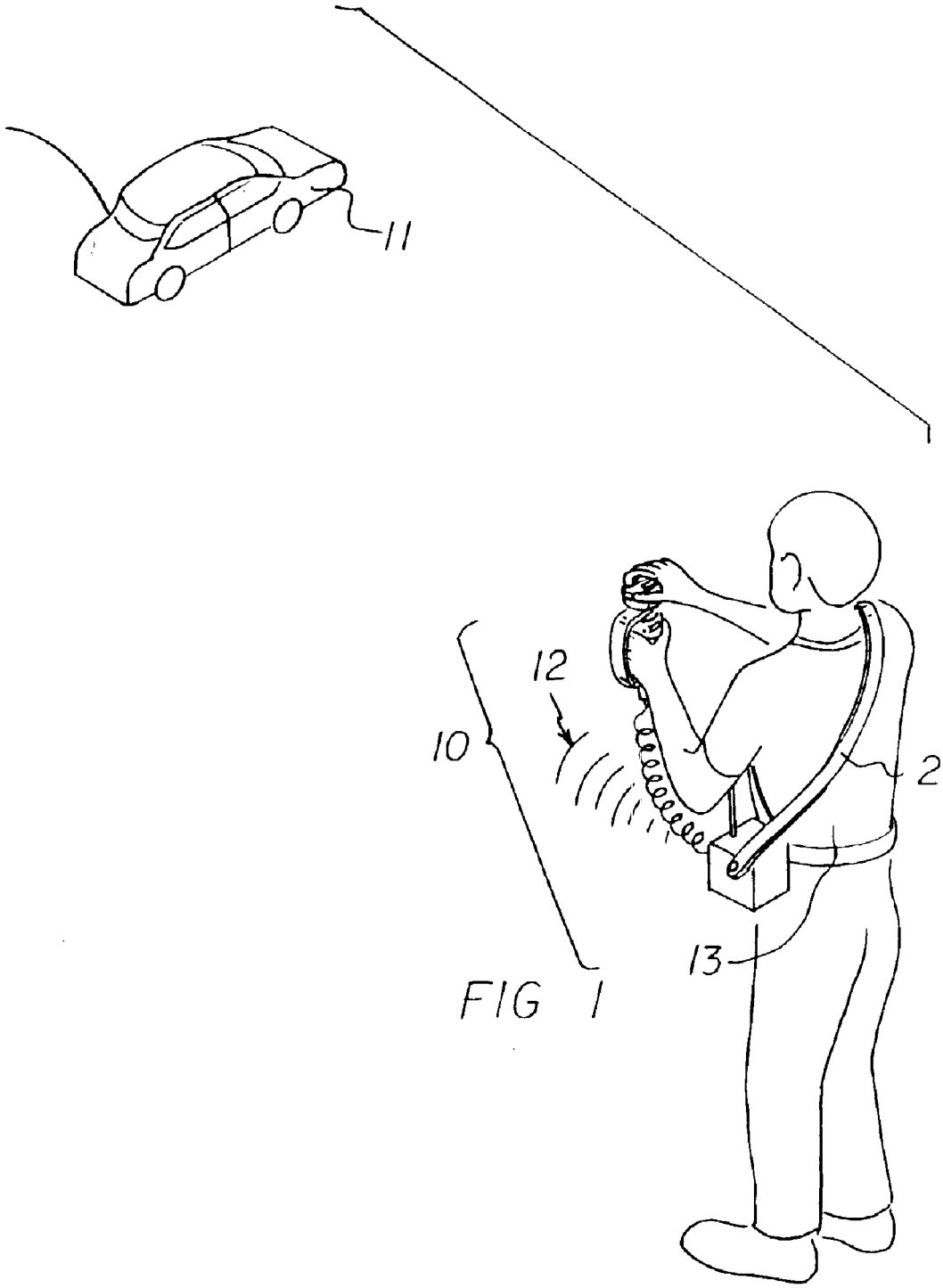
FIG. 1 is a perspective view showing a first embodiment of the remote control apparatus of the invention, in use by a person, for controlling a vehicle.
Figure 2:
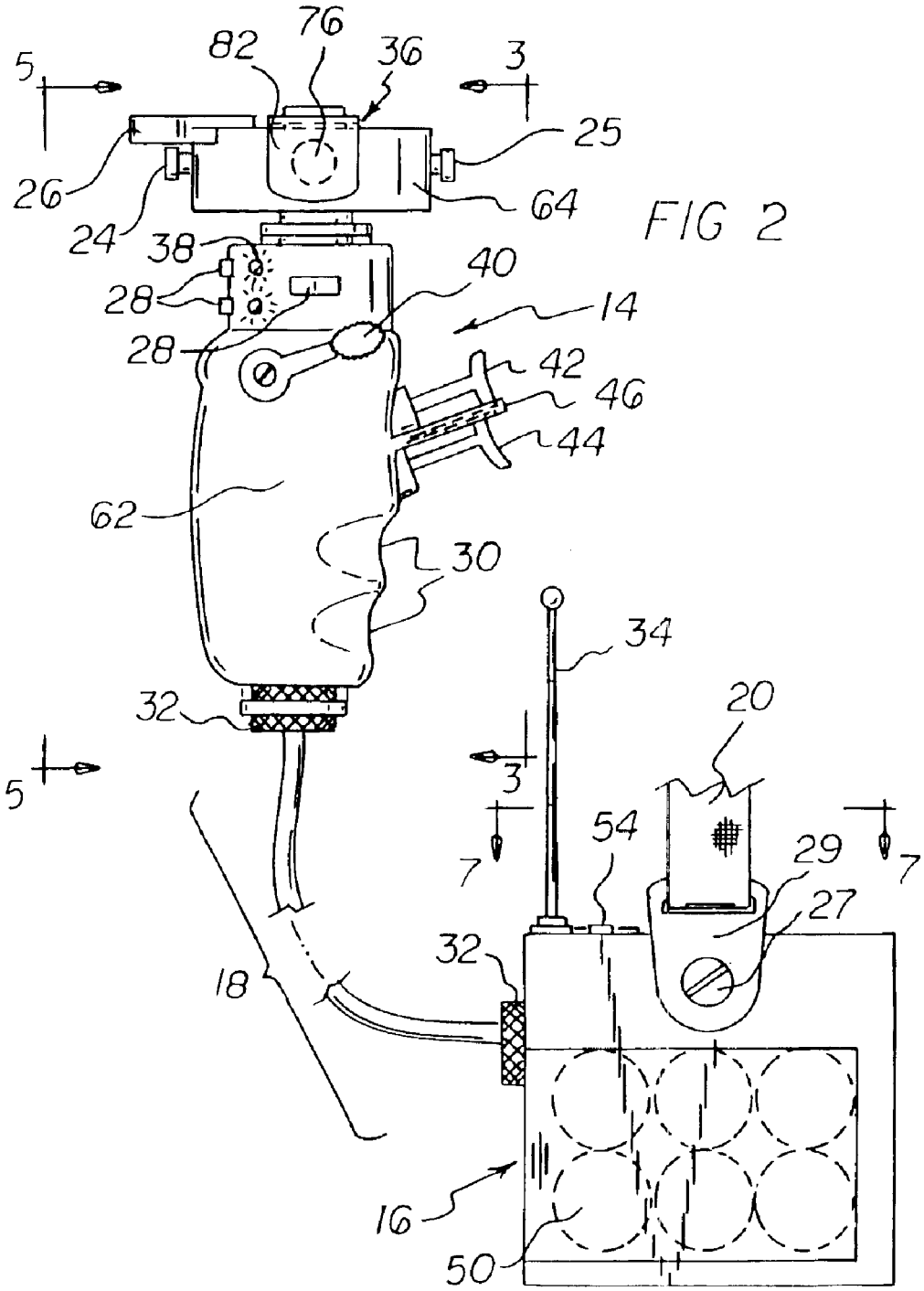
FIG. 2 is a side view of the embodiment of the remote control apparatus shown in FIG. 1, removed from the person.

With reference to the drawings, a new and improved remote control apparatus embodying the principles and concepts of the present invention will be described.

In all FIGS. 1–12, reference numerals are shown that correspond to like reference numerals that designate like elements shown in the other figures.

Turning to FIGS. 1–7, there is shown a first embodiment of the remote control apparatus of the invention generally designated by reference numeral 10. With the first embodiment, a remote control apparatus 10 includes a transmission controller unit 14 and a transmitter unit 16 electrically connected to the transmission controller unit 14. The transmission controller unit 14 includes a transmission-controller-unit housing. A transmission-controller-unit handle 62 is formed from a portion of the transmission-controller-unit housing. An accelerator control finger lever 42 projects outward from a first side portion of the transmission-controller-unit housing. A brake control finger lever 44 projects outward from the first side portion of the transmission-controller-unit housing. A clutch thumb lever 40 projects outward from a second side portion of the transmission-controller-unit housing. A steering wheel 64 is connected to a portion of the transmission-controller-unit housing at a location above the accelerator control finger lever 42, the brake control finger lever 44, and the clutch thumb lever 40. A steering control handle 26 is connected to the steering wheel 64. A gear shift slide actuator 36 is supported on the steering wheel 64. An upshift actuator button 78 and a downshift actuator button 76 are located on the steering wheel 64. The upshift actuator button 78 and the downshift actuator button 76 are operated by the gear shift slide actuator 36. The transmission controller unit 14 controls the emission of radio waves 12 from the transmitter unit 16 for controlling a controlled vehicle 11.

As shown in the embodiments of the invention in FIGS. 1–6, 9, and 10, the accelerator control finger lever 42 projects outward from a first side portion of the transmission-controller-unit handle 62. The brake control finger lever 44 projects outward from the first side portion of the transmission-controller-unit handle 62. The clutch thumb lever 40 projects outward from a second side of the transmission-controller-unit handle 62. The steering wheel 64 is connected to a top portion of the transmission-controller-unit handle 62. The transmission-controller-unit handle 62 includes finger reception grooves 30.

A hand security strap 22 is connected to the transmission-controller-unit handle 62. A stopwatch control button is connected to the steering wheel 64. The stopwatch control button includes a first stopwatch button portion 24 that extends outward from a first location on the steering wheel 64 and includes a second stopwatch button portion 25 that extends outward from a second location on the steering wheel 64.

Trim switches 28 are supported by the transmission-controller-unit housing. Status light indicators 38 are supported by the transmission-controller-unit housing. The trim switches 28 and the status light indicators 38 are located between the transmission-controller-unit handle 62 and the steering wheel 64.

A controller-to-transmitter cable 18 is connected between the transmission controller unit 14 and the transmitter unit 16. The controller-to-transmitter cable 18 includes a screw-on connector 32 for connecting the controller-to-transmitter cable 18 to the transmission controller unit 14 and includes a screw-on connector 32 for connecting the controller-to-transmitter cable 18 to the transmitter unit 16.

The transmitter unit 16 includes transmitter-unit housing. Batteries 50 are housed inside the transmitter-unit housing. A transmitter antenna 34 extends through the transmitter-unit housing. Radio transmitter controls 54 are provided for controlling a transmitter housed inside the transmitter-unit housing.

A shoulder strap 20 can be connected to the transmitter-unit housing. Screws 27 and brackets 29 are provided for securing the shoulder strap 20 to the transmitter-unit housing.

Figure 7:
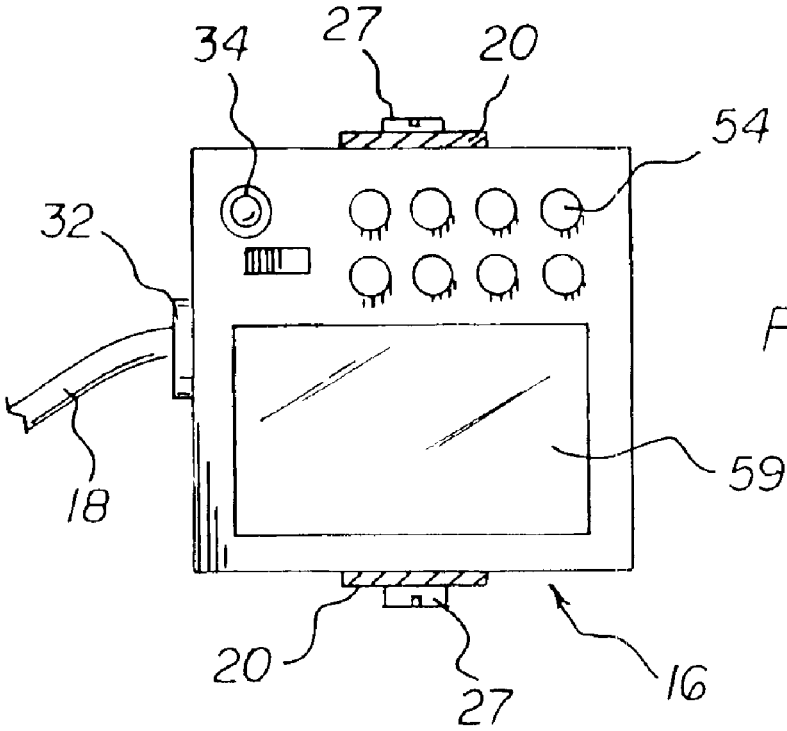
FIG. 7 is a top view of the transmitter unit of the embodiment of the invention in FIG. 2, taken along line 7—7 thereof.
Figure 8:
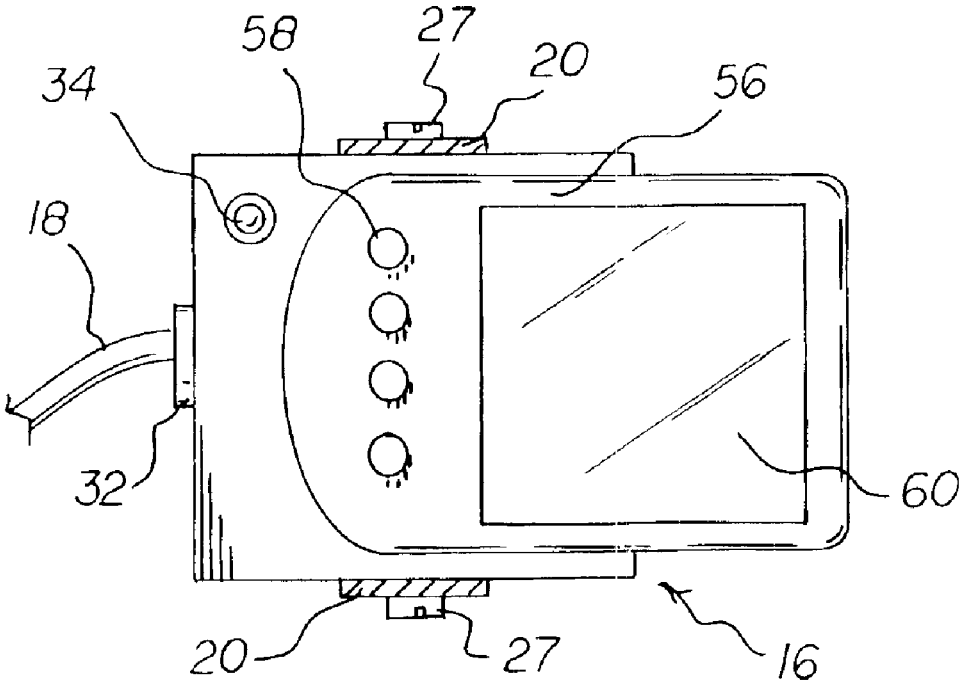
FIG. 8 is a top view of a second embodiment of the transmitter unit of the invention.
Figure 9:
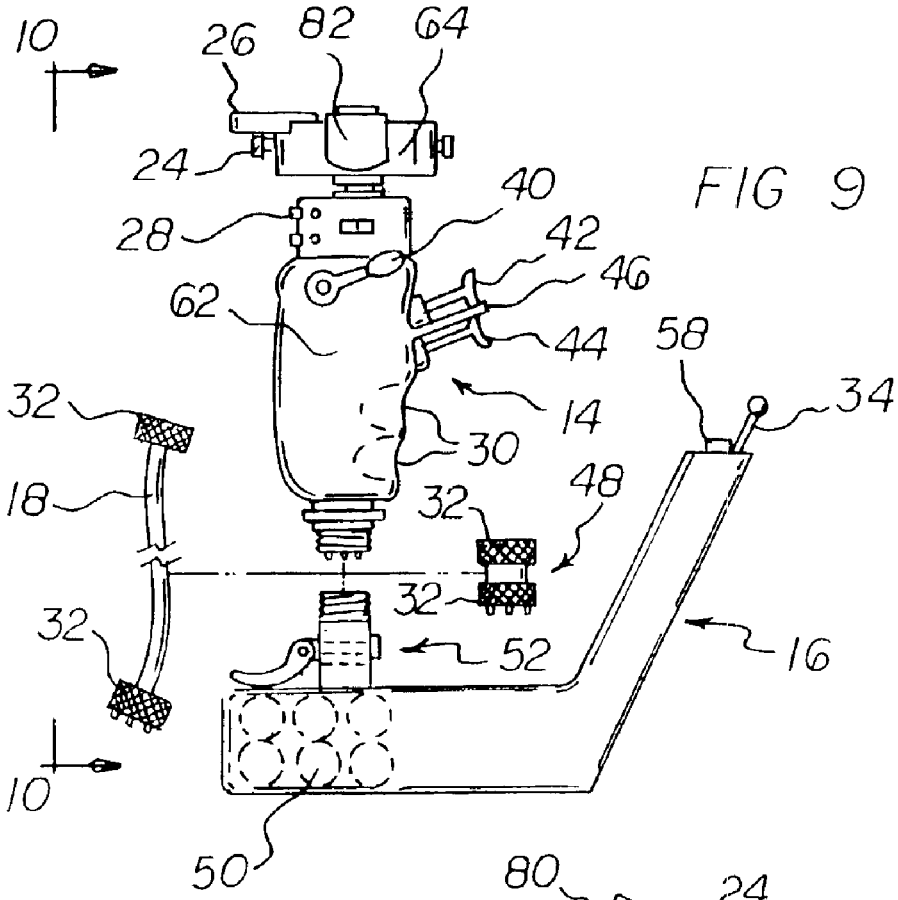
FIG. 9 is a side view of a third embodiment of the invention which includes a direct swivel assembly connection between the transmission controller unit and the transmitter unit.
Figure 10:
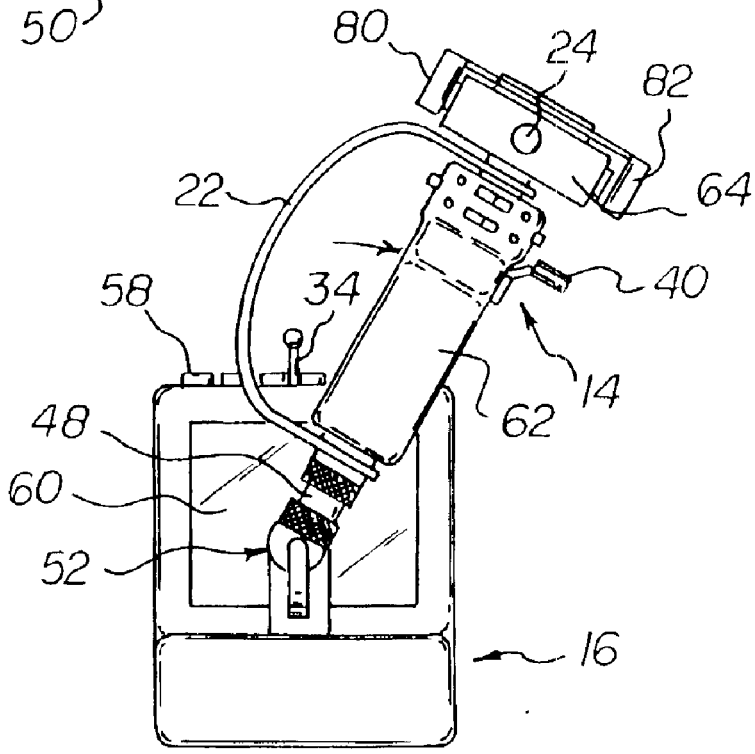
FIG. 10 is a front view of the embodiment of the invention of FIG. 9 taken along line 10—10 thereof.

As shown in FIG. 7, the transmitter unit 16 can include a monitor screen 59. As shown in FIGS. 8–10, the transmitter unit 16 can include a personal digital assistant (PDA), and the PDA includes a PDA screen 60 and PDA controls 58.

Figure 4:
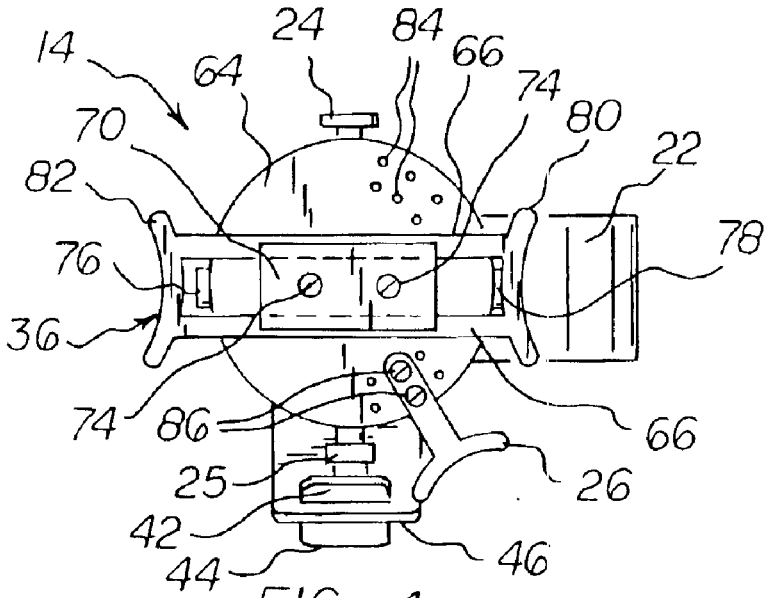
FIG. 4 is a top view of the embodiment of the transmission controller unit shown in FIG. 3, taken along line 4—4 thereof.
Figure 5:
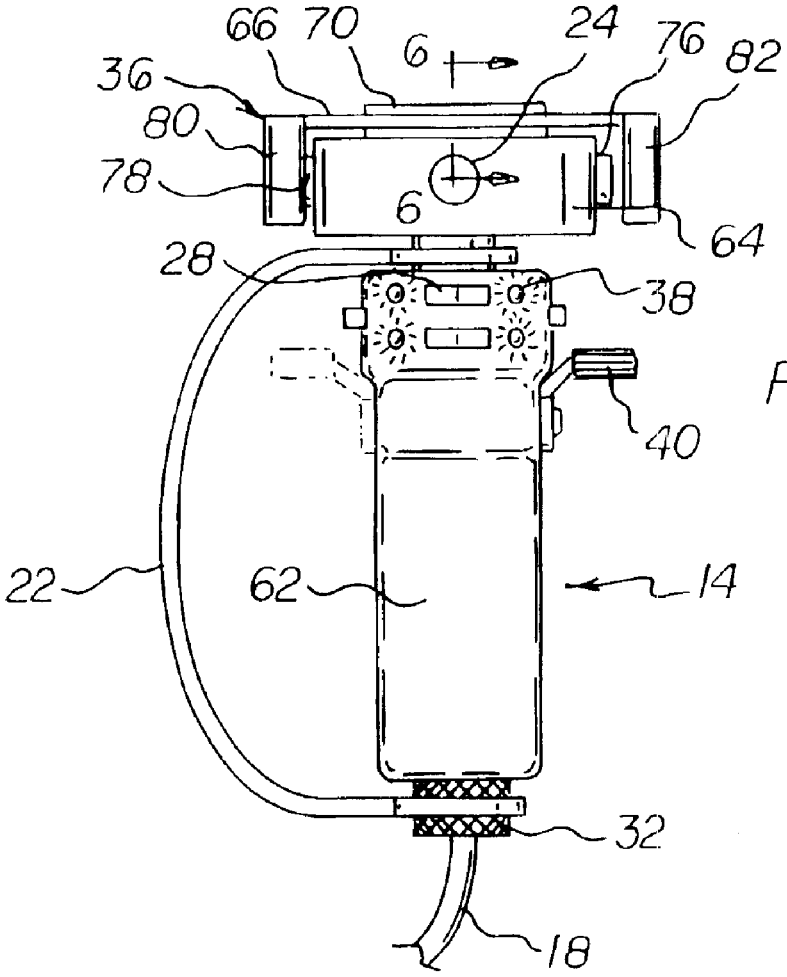
FIG. 5 is a rear view of the transmission controller unit of the embodiment of the remote control apparatus of FIG. 2, taken along line 5—5 thereof.

As shown in FIG. 4, the steering wheel 64 includes a plurality of sets of steering-control-handle adjustment wells 84 for receiving steering-control-handle adjustment screws 86 for attaching the steering control handle 26 to the steering wheel 64 at selected positions on the steering wheel 64. The steering control handle 26 is fastened to the steering wheel 64 in a selected position so that the use of the steering control handle 26 is ergonomically comfortable to the user finger separator plate 46 separates the accelerator control finger lever 42 from the brake control finger lever 44.

Figure 3:
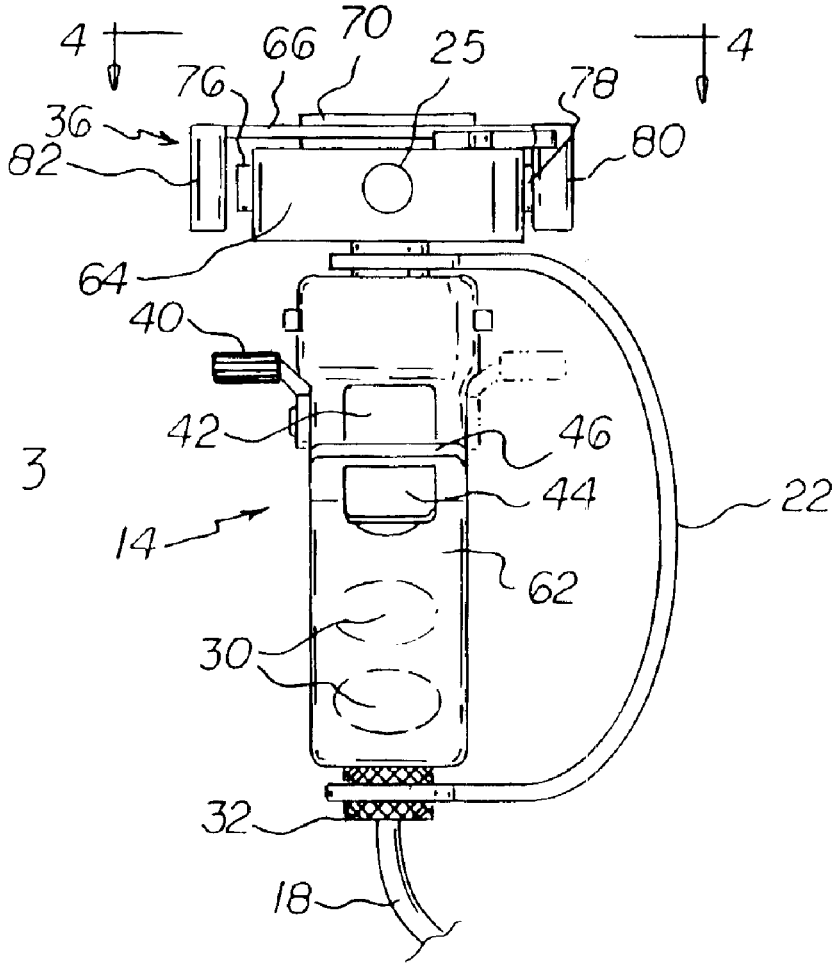
FIG. 3 is a front view of the transmission controller unit of the embodiment of the remote control apparatus of FIG. 2, taken along line 3—3 thereof.

The clutch thumb lever 40 can be fitted alternatively to a left side of the transmission-controller-unit handle 62 or to a right side of the transmission-controller-unit handle 62 to accommodate a left-handed or a right-handed person. In FIG. 3, a left position of the clutch thumb lever 40 is shown in solid lines, and a right position of the clutch thumb lever 40 is shown in broken lines.

The gear shift slide actuator 36 includes a finger-powered upshift button pusher portion 80 for pushing against the upshift actuator button 78. A finger-powered downshift button pusher portion 82 is provided for pushing against the downshift actuator button 76, and rails 66 extend between the finger-powered upshift button pusher portion 80 and the finger-powered downshift button pusher portion 82. The rails 66 ride on tracks supported by the steering wheel 64.

Figure 6:
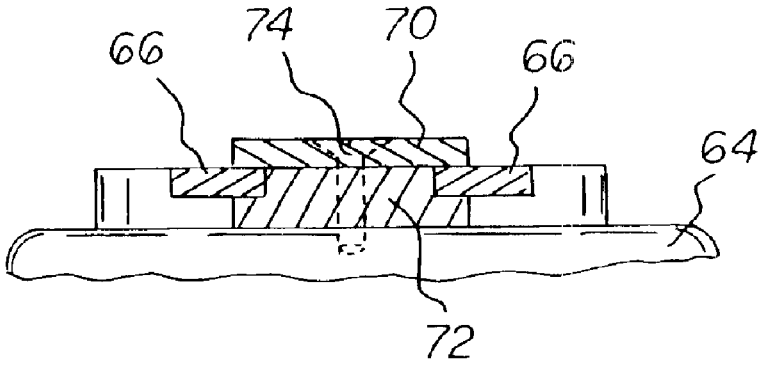
FIG. 6 is an enlarged cross-sectional view of the embodiment of the invention of FIG. 5 taken along line 6—6 thereof.

As shown in detail in FIG. 6, rail support plate 72 is supported on the steering wheel 64. The rail support plate 72 includes notches providing the tracks. A top plate 70 is provided for sandwiching the rails 66 between the top plate 70 and the rail support plate 72. Screws 74 are provided for fastening the rail support plate 72 and the top plate 70 to the steering wheel 64.

As shown in FIGS. 9 and 10, controller-unit-to-transmitter-unit adapter 48 is provided for connecting the transmission controller unit 14 to the transmitter unit 16. The controller-unit-to-transmitter-unit adapter 48 includes a screw-on connector 32 for connecting to the transmission controller unit 14 and includes a screw-on connector 32 for connecting to the transmitter unit 16.

A swivel assembly 52 is connected between the transmission controller unit 14 and the transmitter unit 16. The swivel assembly 52 permits the transmission controller unit 14 to be oriented and tilted around the transmitter unit 16 at a desired orientation.

Figure 11:
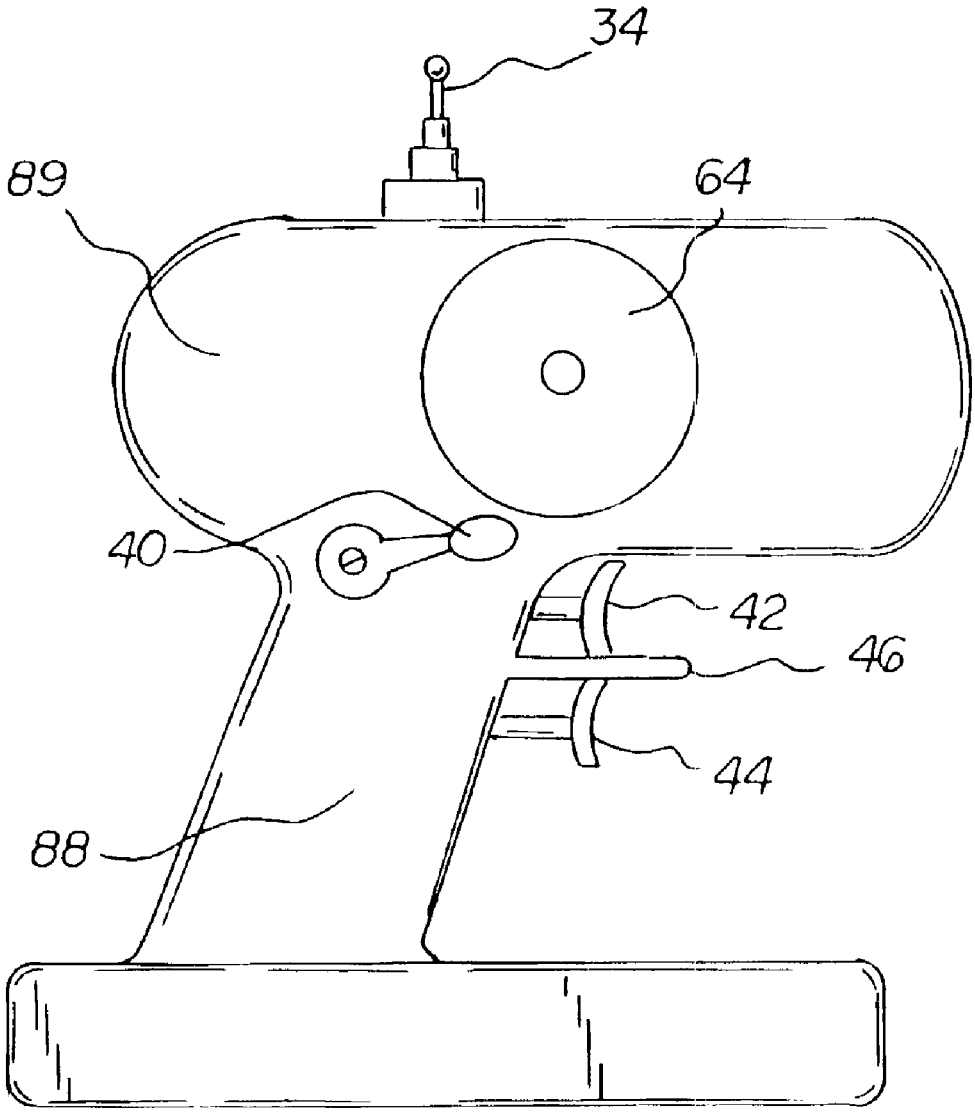
FIG. 11 is a side view of a fourth embodiment of the invention in which the transmission controller unit and the transmitter unit are integrated into a unified pistol grip unit.
Figure 12:
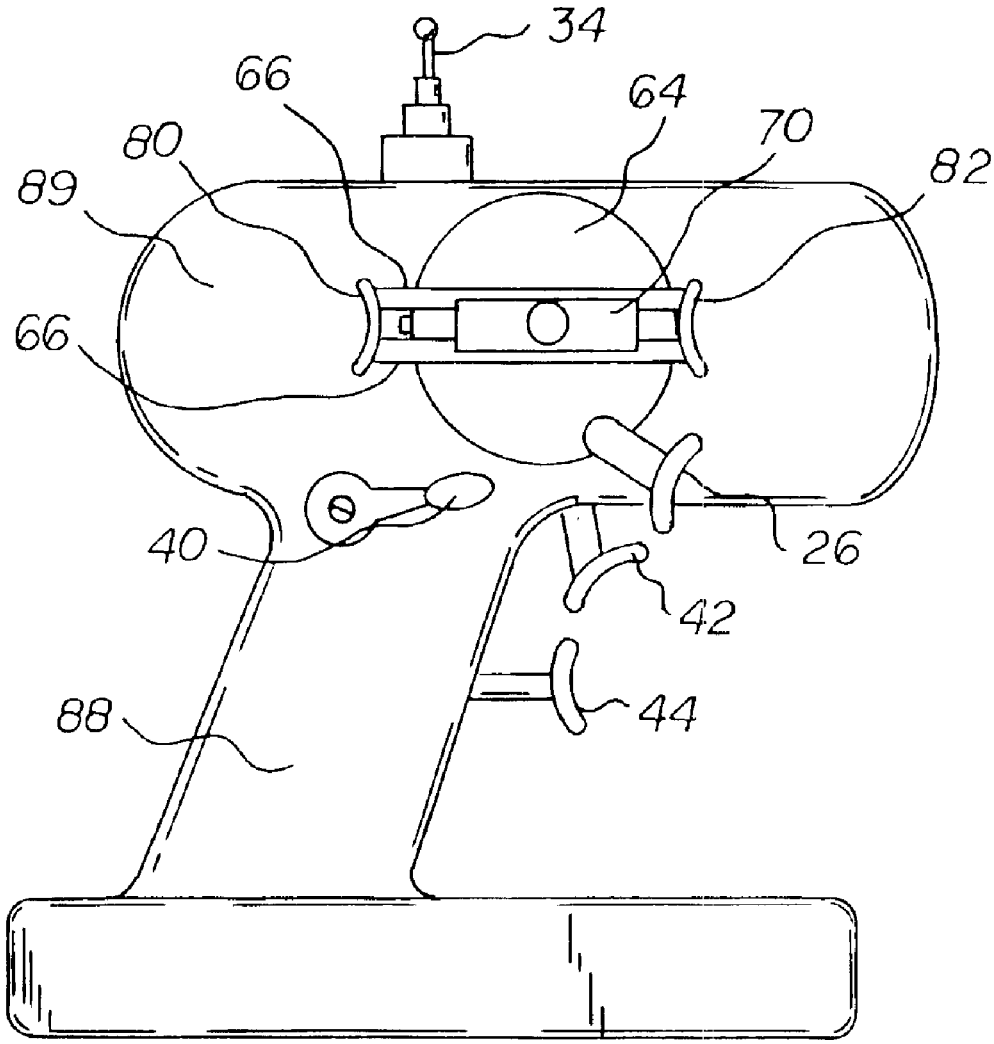
FIG. 12 is a side view of a fifth embodiment of the invention in which the transmission controller unit and the transmitter unit are integrated into a unified pistol grip unit.

As shown in FIGS. 11 and 12, the transmission controller unit 14 and the transmitter unit 16 are combined in a pistol-shaped housing.

As shown in FIG. 11, the accelerator control finger lever 42, a finger separator plate 46, and the brake control finger lever 44 project outwardly from a first side of a pistol handle portion 88. The clutch thumb lever 40 projects outward from a second side of the pistol handle portion 88. The steering wheel 64 projects outward from a side of a pistol body portion 89. The transmitter antenna 34 projects upward from a top portion of the pistol body portion 89.

As shown in FIG. 12, the accelerator control finger lever 42 projects downward from the pistol body portion 89, and the steering control handle 26 projects downward from the steering wheel 64 which is supported by the pistol body portion 89.

To implement embodiments of the invention, it is understood that the clutch thumb lever 40, the accelerator control finger lever 42, the brake control finger lever 44, the upshift actuator button 78, the downshift actuator button 76, the first stopwatch button portion 24, the second stopwatch button portion 25, the radio transmitter controls 54, and the trim switches 28 operate substantially conventional electrical and electronic components and circuits such as disclosed in the following above-mentioned U.S. Pat. Nos. which are incorporated herein by reference 4,865,575, 5,024,626, 5,1,0, 5,334,075, and 5,785,576.

Each of the embodiments of the controller/transmitter apparatus 10 of the invention provides an ergonomic controller/transmitter apparatus that is comfortable with respect to two hands of the person 13 using the apparatus.

With respect to the embodiments of the invention shown in FIGS. 1–10, with one hand of the user, the user's ring finger can be placed on the steering control handle 26. The thumb can be placed on one of the finger-powered upshift button pusher portion 80 or the finger-powered downshift button pusher portion 82, and the middle finger can be placed on the other of the finger-powered upshift button pusher portion 80 or the finger-powered downshift button pusher portion 82. The index finger can be placed on the stopwatch control button 24. The pinky finger need not be not used.

With respect to the other hand of the user, the thumb can control the clutch thumb lever 40. The pinky finger and the ring finger can be placed in the finger reception grooves 30. The index finger and the middle finger can then be used to control the accelerator control finger lever 42 and the brake control finger lever 44.

More specifically with respect to steering, the steering control handle 26 is used for rotating the steering wheel 64. The gear shift slide lever 36 includes two rails 66 which slide along fixed tracks provided by a fixed top plate 70 and a fixed rail support plate 72. The screws 74 fix the top plate 70 and the rail support plate 72 to the steering wheel 64. The gear shift slide actuator 36 also includes a finger-powered upshift button pusher portion 80 for pushing an upshift actuator button 78 and includes a finger-powered downshift button pusher portion 82 for pushing an downshift actuator button 76. Each time the finger-powered upshift button pusher portion 80 pushes against the upshift actuator button 78, the gearing in the controlled vehicle 11 moves upward one gear shift level as result of a gear shifting servo incrementing upward. Conversely. Each time the finger-powered downshift button pusher portion 82 pushes against the downshift actuator button 76, the gearing in the controlled vehicle 11 moves downward one gear shift level as a result of the gear shifting servo incrementing downward. When the gear shift slide actuator 36 moves from one position for actuating the upshift actuator button 78 to another position for actuating the downshift actuator button 76, and vice versa, the rails 66 slide along the tracks formed between the top plate 70 and the rail support plate 72.

The trim switches 28 are calibration switches for the controlling servos for centering or otherwise fine tuning the steering, acceleration, and braking functions.

The status light indicators 38 can be used to indicate the status of a wide variety of conditions. For example, one status light indicator 38 can be used to indicate low battery life. As another example, another status light indicator 38 can be used to indicate that the remote controlled vehicle is in first gear. Such a status light indicator 38 can be color coded, e.g. yellow. As another example, another status light indicator 38 can be used to indicate that the remote controlled vehicle is in second gear. Such a status light indicator 38 can be color coded, e.g. red. As another example, another status light indicator 38 can be used to indicate that the remote controlled vehicle is in third gear. Such a status light indicator 38 can be color coded, e.g. green. A flashing status light indicator 38 can be used to indicate the status of another condition. Other status light indicators 38 can also be employed.

The shoulder strap 20 can be used to support the transmitter unit 16 on a user's shoulder, and the hand security strap 22 can be used to secure a user's hand to the transmission controller unit 14.

With the embodiments of the invention shown in FIGS. 11 and 12, one of the user's hands can grasp the pistol handle portion 88 and use fingers to control the accelerator control finger lever 42 and the brake control finger lever 44 and use that hand's thumb to control the clutch thumb lever 40. The other hand can be used to control the steering wheel 64 and the gear shift slide actuator 36.

The components of the remote control apparatus of the invention can be made from inexpensive and durable electrical and electronic components and metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved remote control apparatus that is low in cost, relatively simple in design and operation, and which may advantageously has means for controlling steering of the controlled vehicle. With the invention, a remote control apparatus is provided which has gears that are shifted or has simulated gears that are shifted. With the invention, a remote control apparatus is provided which includes an independent control for braking a remote controlled vehicle. With the invention, a remote control apparatus is provided which includes a hand operated clutch control. With the invention, a remote control apparatus is provided which includes a hand operated gear shift control that operates in conjunction with the clutch control for changing gears of the remote controlled vehicle. With the invention, a remote control apparatus is provided which includes an operator controlled clutch which provides greater preciseness and flexibility of control than a centrifugal clutch. With the invention, a remote control apparatus is provided which requires less down time for repairs compared to repairs needed for a centrifugal clutch that wears out rapidly. With the invention, a remote control apparatus is provided which has a hand-held controller which is ergonomically comfortable for a user. With the invention, a remote control apparatus is provided which has a hand-held controller, that requires a person to use both hands for controlling a remote controlled vehicle, wherein both hands are ergonomically comfortable to the user. With the invention, a remote control apparatus is provided which has a hand-held controller which allows gears to be shifted incrementally, one gear selection at a time. With the invention, a remote control apparatus is provided which has a hand-held controller that provides for both incremental gear upshifting and incremental gear downshifting.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A remote control apparatus, comprising:

a transmission controller unit, and a transmitter unit electrically connected to said transmission controller unit, wherein said transmission controller unit includes, a transmission-controller-unit housing, a transmission-controller-unit handle which is formed from a portion of said transmission-controller-unit housing, an accelerator control finger lever projecting outward from a first side portion of said transmission-controller-unit housing, a brake control finger lever projecting outward from said first side portion of said transmission-controller-unit housing, a clutch thumb lever projecting outward from a second side portion of said transmission-controller-unit housing, a steering wheel connected to a portion of said transmission-controller-unit housing at a location above said accelerator control finger lever, said brake control finger lever, and said clutch thumb lever, a steering control handle connected to said steering wheel, a gear shift slide actuator supported on said steering wheel, and an upshift actuator button and a downshift actuator button located on said steering wheel, wherein said upshift actuator button and said downshift actuator button are operated by said gear shift slide actuator.

2. The apparatus of claim 1 wherein said transmission controller unit controls the emission of radio waves from said transmitter unit for controlling a controlled vehicle.

3. The apparatus of claim 1 wherein:

said accelerator control finger lever projects outward from a first side portion of said transmission-controller-unit handle, said brake control finger lever projects outward from said first side portion of said transmission-controller-unit handle, said clutch thumb lever projects outward from a second side of said transmission-controller-unit handle, and said steering wheel is connected to a top portion of said transmission-controller-unit handle.

4. The apparatus of claim 1 wherein said transmission-controller-unit handle includes finger reception grooves.

5. The apparatus of claim 1, further including:

a hand security strap connected to said transmission-controller-unit handle.

6. The apparatus of claim 1, further including:

a stopwatch control button connected to said steering wheel.

7. The apparatus of claim 6 wherein said stopwatch control button includes a first stopwatch button portion that extends outward from a first location on said steering wheel and includes a second stopwatch button portion that extends outward from a second location on said steering wheel.

8. The apparatus of claim 1, further including:

trim switches supported by said transmission-controller-unit housing, and status light indicators supported by said transmission-controller-unit housing.

9. The apparatus of claim 8 wherein said trim switches and said status light indicators are located between said transmission-controller-unit handle and said steering wheel.

10. The apparatus of claim 1, further including:

a controller-to-transmitter cable connected between said transmission controller unit and said transmitter unit.

11. The apparatus of claim 10 wherein said controller-to-transmitter cable includes a screw-on connector for connecting said controller-to-transmitter cable to said transmission controller unit and includes a screw-on connector for connecting said controller-to-transmitter cable to said transmitter unit.

12. The apparatus of claim 1 wherein said transmitter unit includes:

a transmitter-unit housing, batteries housing inside said transmitter-unit housing, a transmitter antenna extending through said transmitter-unit housing, and radio transmitter controls for controlling a transmitter housed inside said transmitter-unit housing.

13. The apparatus of claim 12, further including:

a shoulder strap connected to said transmitter-unit housing.

14. The apparatus of claim 13, further including:

screws and brackets for securing said shoulder strap to said transmitter-unit housing.

15. The apparatus of claim 1 wherein:

said steering wheel includes a plurality of sets of steering-control-handle adjustment wells for receiving steering-control-handle adjustment screws for attaching said steering control handle to said steering wheel at selected positions on said steering wheel.

16. The apparatus of claim 1, further including:

a finger separator plate for separating said accelerator control finger lever from said brake control finger lever.

17. The apparatus of claim 1 wherein said clutch thumb lever can be fitted alternatively to a left side of said transmission-controller-unit handle or to a right side of said transmission-controller-unit handle to accommodate a left-handed or a right-handed person.

18. The apparatus of claim 1 wherein said gear shift slide actuator includes:

a finger-powered upshift button pusher portion for pushing against said upshift actuator button, a finger-powered downshift button pusher portion for pushing against said downshift actuator button, and rails extending between said finger-powered upshift button pusher portion and said finger-powered downshift button pusher portion, wherein said rails ride on tracks supported by said steering wheel.

19. The apparatus of claim 18, further including:

a rail support plate supported on said steering wheel, wherein said rail support plate includes notches providing said tracks, a top plate for sandwiching said rails between said top plate and said rail support plate, and screws for fastening said rail support plate and said top plate to said steering wheel.

20. The apparatus of claim 1, further including:

a controller-unit-to-transmitter-unit adapter for connecting said transmission controller unit to said transmitter unit.

21. The apparatus of claim 20 wherein said controller-unit-to-transmitter-unit adapter includes a screw-on connector for connecting to said transmission controller unit and a screw-on connector for connecting to said transmitter unit.

22. The apparatus of claim 1, further including:

a swivel assembly connected between said transmission controller unit and said transmitter unit.

23. The apparatus of claim 1 wherein said transmission controller unit and said transmitter unit are combined in a pistol-shaped housing.

24. The apparatus of claim 23 wherein:

said accelerator control finger lever, a finger separator plate, and said brake control finger lever project outwardly from a first side of a pistol handle portion, said clutch thumb lever projects outward from a second side of said pistol handle portion, said steering wheel projects outward from a side of a pistol body portion, and said transmitter antenna projects upward from a top portion of said pistol body portion.

25. The apparatus of claim 23 wherein:

said accelerator control finger lever projects downward from said pistol body portion, and said steering control handle projects downward from said steering wheel which is supported by said pistol body portion.

* * * * *